United States Patent [19]

Winslow

[11] 4,336,323

[45] Jun. 22, 1982

[54] DECOLORIZABLE IMAGING SYSTEM

[75] Inventor: John M. Winslow, South Saint Paul, Minn.

[73] Assignee: Minnesota Mining and Manufacturing Company, St. Paul, Minn.

[21] Appl. No.: 199,426

[22] Filed: Oct. 22, 1980

Related U.S. Application Data

[63] Continuation-in-part of Ser. No. 101,144, Dec. 7, 1979, abandoned.

[51] Int. Cl.[3] ..... G03C 1/52; G03C 1/84

[52] U.S. Cl. ..... 430/339; 430/517; 430/519; 430/520; 430/521; 430/522; 428/913; 106/193 D; 106/22; 427/148; 524/429; 524/403; 524/83; 524/95; 524/84; 524/89; 524/237; 524/190; 524/92; 524/110; 524/357; 524/100; 524/105; 525/94; 524/159

[58] Field of Search ..... 430/517, 519, 520, 521, 430/522, 339; 428/913; 260/37 N, 40 R, 37 PC, 42.21; 106/193 D, 22; 427/148

[56] References Cited

U.S. PATENT DOCUMENTS

| | | | |
|---|---|---|---|
| 1,916,350 | 7/1933 | Wendt et al. | 430/339 |
| 2,390,707 | 12/1945 | Heimbach | 430/519 |
| 2,772,284 | 11/1956 | Barnhart et al. . | |
| 2,880,153 | 3/1959 | Hiltz et al. | 204/158 |
| 2,884,326 | 4/1959 | Zemp . | |
| 3,300,314 | 1/1967 | Rauner et al. | 430/339 |
| 3,390,997 | 7/1968 | Read . | |
| 3,460,964 | 8/1969 | Dunham . | |
| 3,595,655 | 7/1971 | Robinson et al. | 430/339 |
| 3,595,657 | 7/1971 | Robinson et al. | 430/339 |
| 3,615,548 | 10/1971 | Firestine | 430/520 |
| 3,705,807 | 12/1972 | Busatto | 430/522 |
| 3,745,009 | 7/1973 | Jenkins et al. | 430/522 |
| 3,801,319 | 4/1978 | Saeva et al. . | |
| 3,988,154 | 10/1976 | Sturmer | 430/339 |
| 4,017,313 | 4/1977 | Hartzler . | |

FOREIGN PATENT DOCUMENTS

| | | |
|---|---|---|
| 51-941 | 1/1976 | Japan . |
| 51-27544 | 8/1976 | Japan . |
| 51-43786 | 11/1976 | Japan . |
| 52-23806 | 6/1977 | Japan . |
| 52-25330 | 7/1977 | Japan . |

OTHER PUBLICATIONS

Light-Sensitive Systems, J. Kosar, 1965, John Wiley & Sons, Inc., N. Y., N. Y., pp. 187 and 193, 380 and 398.

Pure and Applied Chemistry, vol. 49, pp. 353-356, Pergamon Press, Great Britain 1977, "Aromatic Aldehyde-Leuco Dye Photoxidation," H. D. Hartzl.

*Primary Examiner*—Won H. Louie, Jr.

*Attorney, Agent, or Firm*—Cruzan Alexander; Donald M. Sell; Mark A. Litman

[57] ABSTRACT

A light insensitive imageable layer comprising a synthetic polymeric binder, a dye, a nitrate salt, and an acid.

12 Claims, No Drawings

DECOLORIZABLE IMAGING SYSTEM

This application is a continuation-in-part of U.S. patent application Ser. No. 101,144, filed Dec. 7, 1979, now abandoned.

FIELD OF THE INVENTION

A layer comprising an oxidizing ion and dye in a binder is useful as either an imaging layer or as a heat-bleachable antihalation layer. The antihalation layer is particularly useful in photothermographic systems where the development temperature acts to bleach the dye.

SUMMARY OF THE INVENTION

The present invention may be practiced in any polymeric binder system having the necessary active ingredients therein. These ingredients comprise dyes and a non-dye-reactive nitrate salt. The active agents may also include any material which supplies hydrogen ion, such as an acidic material, and in particular an acid. A binder material containing these ingredients can be decolorized locally by heating portions of the binder layer or generally decolorized by heating the entire layer. The presence of an acidic material accelerates the decolorization phenomenum.

DETAILED DESCRIPTION OF THE INVENTION

There are a minimum of three components to the present invention, and four components to the preferred construction of the present invention. The three required components are the dye, the nitrate salt, and the polymeric binder.

The Binder

Any polymeric binder may be used in the practice of the present invention. The pH of the resin has been found to affect only the speed of the discolorizing effect. If the speed is not important, any resin may be used. Organic polymeric resins, preferably thermoplastic although thermoset resins may be used, are generally preferred. Where speed is more important, either the more acidic resins should be used or an acid should be added to the system to decrease the pH and increase the rate of decolorizing. Such resins as polyvinyl acetals, polyesters, polyvinyl resins, polyvinylpyrolidone, polyesters, polycarbonates, polyamides, polyvinyl butyral, polyacrylates, cellulose esters, copolymers and blends of these classes of resins, and others have been used with particular success. Natural polymeric materials such as gelatin and gum arabic may also be used. Where the proportions and activities of dyes and nitrate ion require a particular developing time and temperature, the resin should be able to withstand those conditions. Generally it is preferred that the polymer not decompose or lose its structural integrity at 200° F. (93° C.) for 30 seconds, and more preferred that it not decompose or lose its structural integrity at 260° F. (127° C.) for 30 seconds and most preferred that it withstand 290° F. (144° C.) for 60 seconds.

Beyond these minimal requirements, there is no criticality in the selection of a binder. In fact, even transparency and translucency are not required, although they are desirable. Where, for example, the polymer is itself an opaque white, the thermally treated area will become white and the non-treated areas will remain the color of the dye.

The binder serves a number of additionally important purposes in the constructions of the present invention. The imageable materials are protected from ambient conditions such as moisture. The consistency of the coating and its image quality are improved. The durability of the final image is also significantly improved.

The Nitrate Salt

Nitrate salts are themselves well known. They may be supplied as various compounds forms, but are preferably provided as a metal salt, and most preferably provided as a hydrated metal salt. Other ions which are ordinarily good oxidizing ions such as nitrite, chlorate, iodate, perchlorate, periodate, and persulfate do not provide comparable results. Extremely active oxidizing agents, such as iodate, even used in relatively smaller proportions to prevent complete and immediate oxidation or decolorization of dyes do not perform nearly as well as nitrate ion compositions. The performance of nitrate is so far superior to any other ion that it is apparently unique in the practice of the present invention. While some of the better oxidizing ions other than nitrate can only produce modest differences between the maximum optical density ($D_{max}$) and the minimum optical density ($D_{min}$) or produce high $D_{min}$ values even in their best constructions, the better constructions with nitrate ions can have a $D_{max}$ in excess of 1.0 and a $D_{min}$ below 0.10.

Most means of supplying the nitrate ion into the composition are satisfactory. E.g., metal salts, acid salts, mixtures of acids and salts, and other means of supplying the ion are useful. For examples, nitrates of zinc, cadmium, potassium, calcium, zirconyl, nickel, aluminum, chromium, iron, copper, magnesium, lead, and cobalt, ammonium nitrate, and cerous ammonium nitrate have been used.

The nitrate salt component of the present invention must be present in a form within the imaging layer so that $HNO_3$, NO, $NO_2$, or $N_2O_4$ will be provided within the layer when it is heated to a temperature no greater than 200° C. for 60 seconds and preferably no greater than 160° C. for 60 or most preferably 30 seconds. This may be accomplished with many different types of salts, both organic and inorganic, and in variously different types of constructions.

The most convenient way of providing such thermal oxidant providing nitrate salts is to provide a hydrated nitrate salt such as aluminum nitrate nonahydrate ($Al(NO_3)_2.9H_2O$). This salt, when heated in a binder, will generate $HNO_3$, NO, $NO_2$ and/or $N_2O_4$ in various amounts. The binder should not be at such a high pH that the liberated nitric acid would be immediately neutralized as this would adversely affect the oxidizing capability of the system. It is not essential that a completely acidic or neutral pH environment be provided, but pH levels above 8.5 may in many cases completely prevent oxidation. It is therefore desired that the nitrate salt containing layer have a pH less than 7.5, preferably equal to or less than 7.0, and more preferably equal to or less than 6.5.

In addition to hydrated nitrate salts, non-hydrated salts in layers having a pH less than 7.5, and preferably in an acidic environment are also capable of providing $HNO_3$. NO, $NO_2$, and/or $N_2O_4$ in sufficient quantities to provide the oxidizing capability necessary for practice of the present invention. Ammonium nitrate, for example, does not enable good oxidation in the present invention in a layer having a pH of 8.0 or higher, but when a moderate strength organic acid such as phthalic acid is added to lower the pH to below 7.0, a quite acceptable imaging system is provided.

Beside the inorganic types of salts generally described above, organic salts in non-alkaline environments are also quite useful in the practice of the present invention. In particular, nitrated quaternary ammonium salts such as guanadinium nitrate work quite well in acid environments, but will not provide any useful image at alkaline pH levels of 8.0 or higher.

It is believed that the alkaline environment causes any oxidizing agent (e.g., $HNO_3$, NO, $NO_2$ and/or $N_2O_4$) which is liberated from the nitrate salt to be preferentially reacted with hydroxy ions or other neutralizing moieties so as to prevent oxidation of the dyes. For this reason it is preferred to have the environment of the nitrate salt at a pH no greater than 7.0 and more preferably less than 6.5.

One other consideration should be given in the selection of the nitrate salt and that is the choice of a salt in which the cation is non-reactive with the dye. Non-reactive salts are defined in the practice of the present invention as those salts the cations of which do not spontaneously oxidize the dyes that they are associated with at room temperature. This may be readily determined in a number of fashions. For example, the dye and a non-nitrate (preferably halide) salt of the cation may be codissolved in a solution. If the salt oxidizes the dye spontaneously (within two minutes) at room temperature, it is a reactive salt. Such salts as silver nitrate, in which the cation is itself a strong oxidizing agent, is a reactive salt. Cerric nitrate is also reactive, while hydrated cerrous nitrate is not.

Preferred salts are the hydrated metal salts such as nickel nitrate hexahydrate, magnesium nitrate hexahydrate, aluminum nitrate nonahydrate, ferric nitrate nonahydrate, cupric nitrate trihydrate, zinc nitrate hexahydrate, cadmium nitrate tetrahydrate, bismuth nitrate pentahydrate, thorium nitrate tetrahydrate, cobalt nitrate hexahydrate, gadolinium or lanthanum nitrate nonahydrate, mixtures of these hydrated nitrates and the like. Nonhydrated or organic nitrates may be admixed therewith.

Organic nitrates are also quite useful in the practice of the present invention. These nitrates are usually in the form of quaternary nitrogen containing compounds such as guanadinium nitrate, pyridinium nitrate, and the like. Nitrated dyes will also be useful, but again, they must be used in an environment which will not neutralize any liberated $HNO_3$, NO, $NO_2$, and/or $N_2O_4$.

It is preferred to have at least 0.10 moles of nitrate ion per mole of dye. It is more preferred to have at least 0.30 or 0.50 moles of ion per mole of dye. Even amounts of from 1.0 to 100 moles of nitrate ion per mole of dye have been found useful. With dyes having relatively higher oxidation potentials, more nitrate is desirable.

Dyes

It is believed that essentially all dyes are useful in the present invention. With some constructions it may be desirable to select dyes which have an oxidation potential of less than or equal to +1.0. The dyes may be selected from any class of dyes. These classes include but are not limited to (1) methines, (2) indamines, (3) anthraquinones, (4) triarylmethanes, (5) benzylidenes, (6) monoazos, (7) oxazines, (8) azines, (9) thiazines, (10) xanthenes, (11) indigoids, (12) oxonols, (13) cyanines, (14) merocyanines, (15) phenols, (16) naphthols, (17) pyrazolones, and others, of which most are classified by the Colour Index System.

The measurement of oxidation potentials is well known to the ordinarily skilled artisan. The measurements in the present invention are taken by measuring the voltage and current transferred between a carbon and a platinum electrode through the appropriate solution. 0.1 M lithium chloride in anhydrous methanol with 1 to 10 millimoles/liter of the appropriate dye was the standard solution used in the measurements given herein with a saturated calomel electrode.

It is preferred to have sufficient dye in the binder prior to imaging so that at least 15% of incident radiation (including ultraviolet and infrared) in a 50 nm range would be absorbed through a 0.5 mm layer of binder and dye. Preferably at least 75% of the incident radiation in a 20 nm range would be absorbed. These ranges must of course be chosen within the spectral absorption region of the particular dye, but such absorption in any portion of the spectra is useful. In terms of weight percentages, it would be preferred to have at least 0.30% by weight of dye as compared to the binder. Preferably, at least 0.50% by weight of dye to binder is desired and most preferably there should be at least 1% by weight of dye to binder in the layer up to 10% or more.

The dyes which have been specifically shown to work in the present invention include but are not limited to the following:

Methines

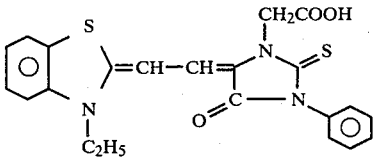

I

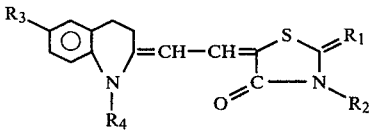

II wherein $R_1$ = 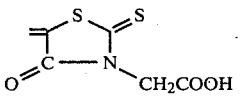

=S;

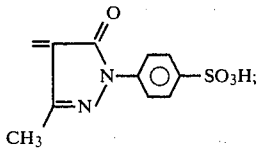

-continued
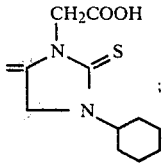
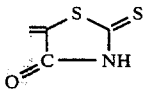
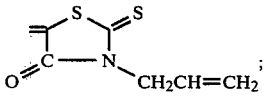
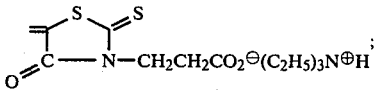
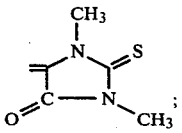
$=CHNO_2$; or
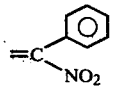
$R_2 = C_2H_5$; $C_7H_{15}$; $(CH_2)_5COOH$; $C_8H_{17}$; $CH_2CH_2\phi$; or $CH_2COOH$
$R_3 = H$; $C_2H_5O$; or Cl
$R_4 = C_2H_5$; or $CH_2CH_2C_6H_5$
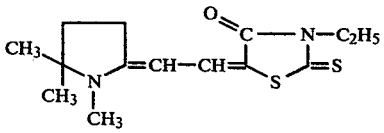
III
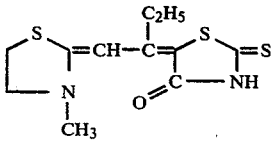
IV
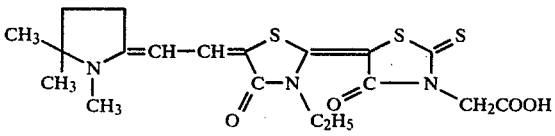
V
-continued
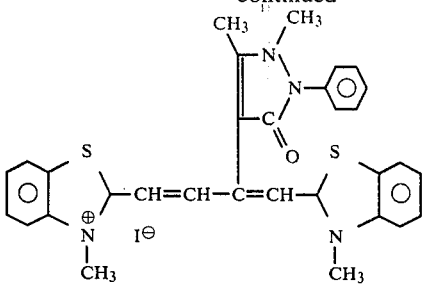
VI
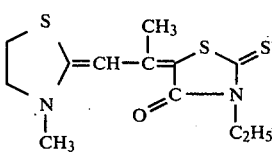
VII
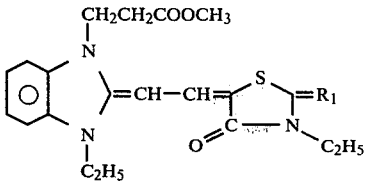
VIII
wherein
$R_1 =$ 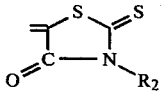
$R_2 = H$; $-CH_2COOH$; or $-CH_2CH=CH_2$
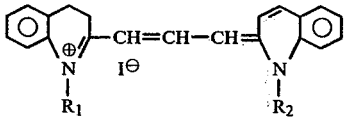
IX
wherein
$R_1 = C_2H_5$; $n\text{-}C_3H_7 = R_2$
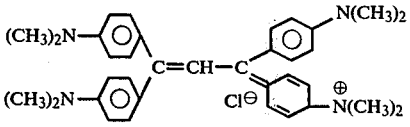
X
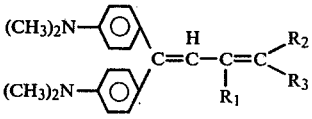
XI
wherein
$R_1 = H$; or $-CN$
$R_2 = -CN$; or $-SO_2CF_3 = R_3$ -continued

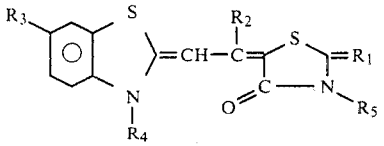

XII wherein $R_1$ = =S;

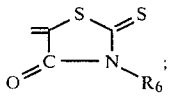

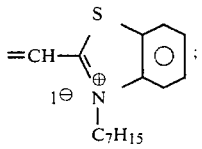

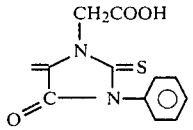

$R_2$ = H; $CH_3$ = $R_3$ $R_4$ = $C_2H_5$; $CH_2CH{=}CH_2$; or $CH_2CH_2CO_2C_2H_5$ $R_5$ = $C_2H_5$; $-CH_2CH-CH_2$; or $-C_7H_{15}$ $R_6$ = $-CH_2COOH$; $-CH_2CH{=}CH_2$; or $-(CH_2)_2SO_3H$

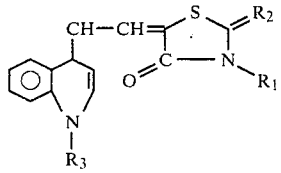

XIII wherein $R_1$ = $-C_2H_5$; $-C_7H_{15}$; or $-CH_2CH{=}CH_2$ $R_2$ = =S; or $=C(CN)_2$ $R_3$ = $-CH_3$; or $-C_2H_5$

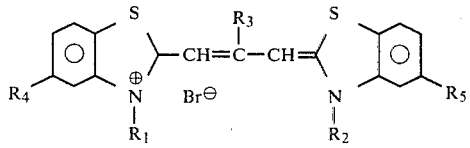

XIV wherein $R_1$ = $-C_2H_5$; $-(CH_2)_2OH$; $-(CH_2)_2COOH$; $-CH_2COOH$; or $-(CH_2)_3SO_3^-$ $R_2$ = $-C_2H_5$; $-(CH_2)_2OH$; $-(CH_2)_2COOH$; $-CH_2COOH$; or $-CH_3$ $R_3$ = H; $-CH_3$; $-SCH_3$; or $-C_2H_5$ -continued $R_4$ = H; $-CH_3$; $-Br$; or $-N(C_2H_5)_2$ $R_5$ = H; $-CH_3$; or $-Br$

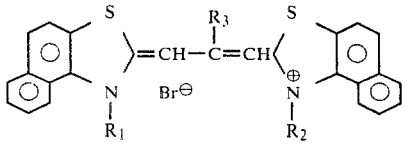

XV wherein $R_1$ = $-CH_3$; $-C_2H_5$ = $R_2$ = $R_3$

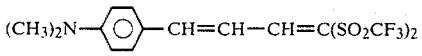

XVI

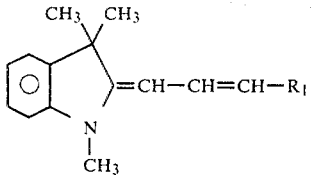

XVII wherein

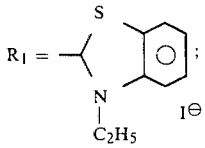

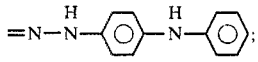

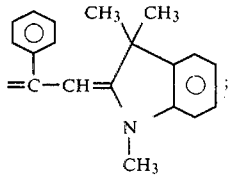

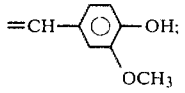

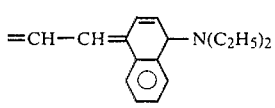

$R_3$ = H; Br

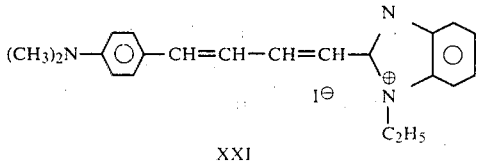

XXI

-continued
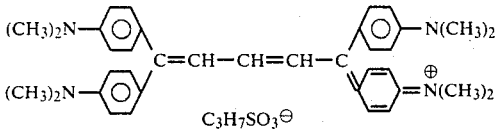
XXII
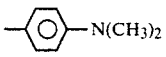
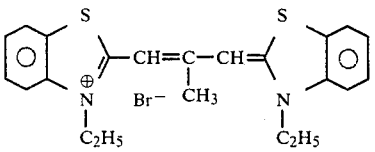
XVIII
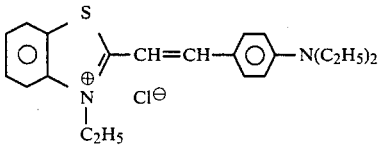
XIX
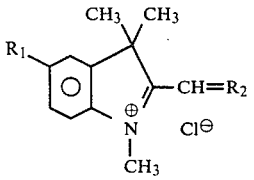
XX
wherein
$R_1$ = H; Cl
$R_2$ = 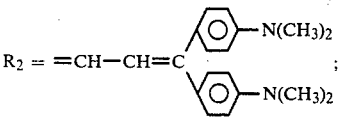 ;
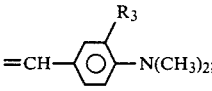
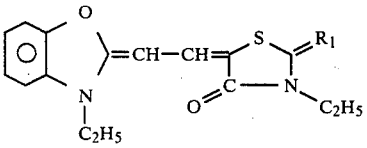
XXIII
wherein
$R_1$ = S;
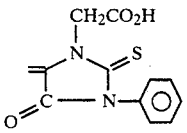
-continued
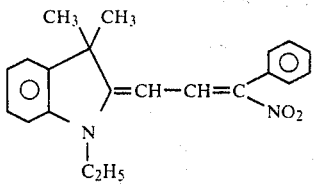
XXIV
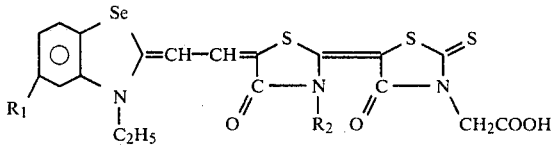
XXV
wherein
$R_1$ = $-CH_3$; or $CH_3O-$
$R_2$ = $-C_2H_5$; or $-C_7H_{15}$
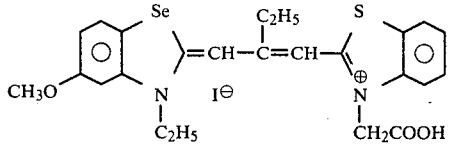
XXVI
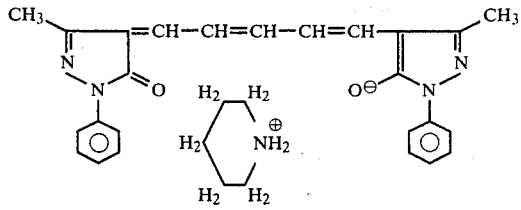
XXVII
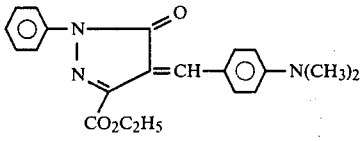
XXVIII
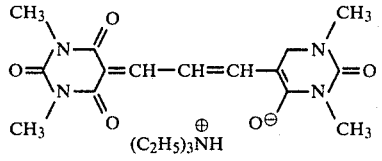
XXIX
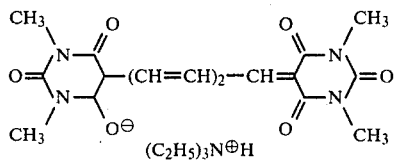
XXX -continued
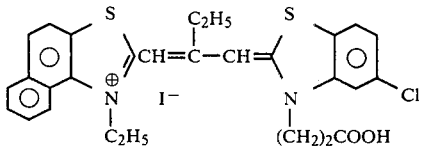
XXXI
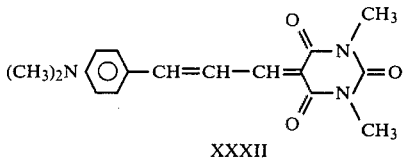
XXXII
Anthraquinones
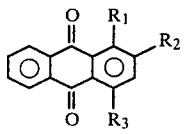
XXXIII
wherein
$R_1$ = —OH; —$NH_2$; —$NHC_2H_5$
$R_2$ = H; —OH; —$OCH_3$
$R_3$ = H; —OH; or —$NHC_2H_5$
Indigoids
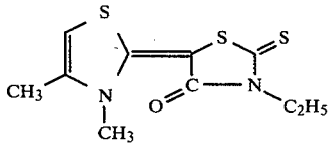
XXXIV
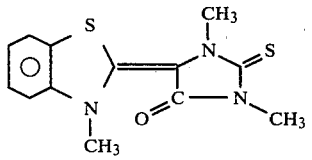
XXXV
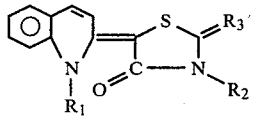
XXXVI
wherein
$R_1$ = H; —$CH_3$; or —$C_2H_5$
$R_2$ = H; —$C_2H_5$; or —$CH_2COOH$
$R_3$ = =S; or =$CHNO_2$
-continued
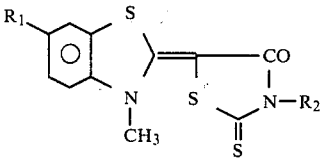
XXXVII
wherein
$R_1$ = H; or $CH_3O$—
$R_2$ = —$C_2H_5$; —$CH_2CO_2^-(C_2H_5)_3N^+H$
Xanthenes
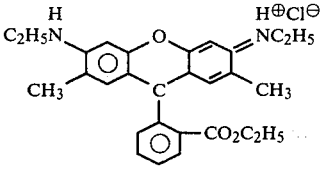
XXXVIII
Azines
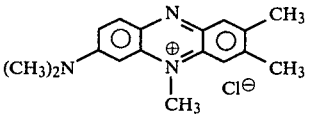
XXXIX
Oxazines
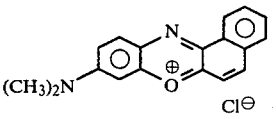
XL
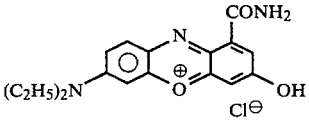
XLI
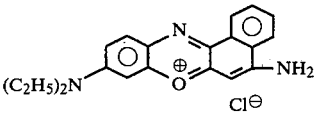
XLII
Thiazines
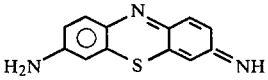
XLIII
Azos -continued

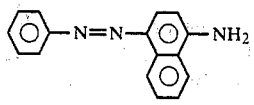

XLIV

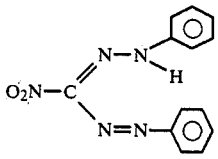

XLV

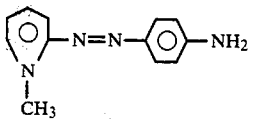

XLVI

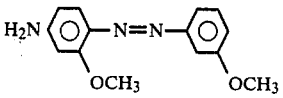

XLVII

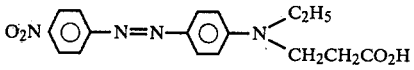

XLVIII

Diazos

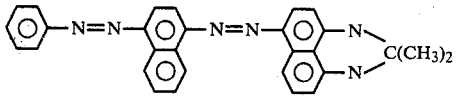

XLIX

Triarylmethanes

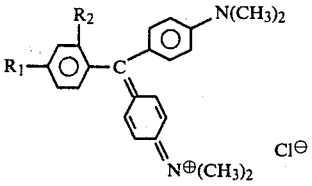

L wherein $R_1$ = H; $-N(CH_3)_2$ $R_2$ = H; $-Cl$

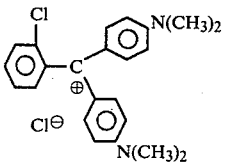

LI

Indamines

-continued

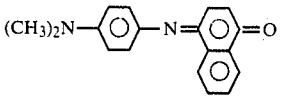

LII

The following two dyes cannot be conveniently classed by the Colour Index System:

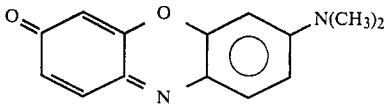

LIII

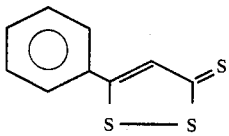

LIV

These examples are not intended to represent the limits of the present invention. Any dye having an oxidation potential of +1.0 or less may work in the present invention. The substituent groups and dye structure are unimportant.

The dyes of the present invention are preferably colored, that is, having absorbance in the visible portion of the electromagnetic spectrum (approximately 400 to 700 nm), but may also be colorless, having absorbance only or predominately in the infrared (700 to 1100 nm) or ultraviolet (310 to 400 nm) portions of the electromagnetic spectrum. The images where colorless dyes are used must then be viewed through a filter, by an ultraviolet sensitive apparatus, or by some enhancement technique.

There should be sufficient dye present in the layers of this invention so that an optical density of at least 0.1 in the visible portions of the spectrum is obtained or at least 5% of incident colorless light (including ultraviolet or infrared) is absorbed. It is preferred that an optical density of at least 0.5 or 0.8 be obtained and most preferably that there be sufficient dye so that an optical density of at least 1.0 be obtained in the layer. With colorless dyes (e.g., ultraviolet and infrared absorbing dyes), it is preferred that at least 20% or 40% of incident radiation be absorbed and most preferably that at least 60% or 90% of the incident colorless light within a 20 nm range be absorbed.

The proportions of nitrate ion and dye should be such that on heating the layer at 260° F. (127° C.) for 30 seconds there is at least a 20% reduction in optical density, although with a mechanical viewing of the image, a lower reduction in optical density is useful. Depending upon the relative ease of decolorizing the particular dye selected, the relative proportion of nitrate ion to dye may vary. As a general rule, at least 0.1 moles of nitrate ion per mole of dye is desirable in the practice of the present invention. At least 0.3 or 0.5 moles of nitrate per mole of dye is more preferred, and at least 0.7 or 0.9 moles of nitrate per mole of dye is most preferred. Where the decolorizable layers of the present invention are used as antihalation layers, particularly with thermally developable imaging materials, more than a 20% reduction in optical density is usually desirable. At least 50% or 60% is preferred and at least 90% or 95% reduction in optical density is most preferred. These reductions can be measured at the development temperatures for the imaging materials, e.g., 127° C. for 30 seconds or 155° C. for 45 seconds.

The acids optionally useful in the present invention are acids as generally known to the skilled chemist. Organic acids are preferred, but inorganic acids (generally in relatively smaller concentrations) are also useful. Organic acids having carboxylic groups are more preferred. The acid may be present in a ratio of from 0 to 10 times the amount of the nitrate ion. More preferably it is present in amounts from 0.2 to 2.0 times the amount of nitrate ion.

In forming the dye layers or coating of the dye layers onto a substrate, temperatures should, of course, not be used during manufacture which would completely decolorize the layer. Some decolorization is tolerable, with the initial dye concentrations chosen so as to allow for anticipated decolorization. It is preferred, however, that little or no dye be decolorized during forming or coating so that more standardized layers can be formed. Depending on the anticipated development temperature, the coating or forming temperature can be varied. Therefore, if the anticipated development temperature were, for example, 350° F. (167° C.) the drying temperature could be 280° F. (138° C.) and it would not be desirable for the layer to lose 20% of its optical density at the drying temperature in less than 4–5 minutes, although it would be tolerable by correspondingly increasing the amount of dye. Thus the preferred limitation of at least 20% reduction in optical density or absorbance of colorless light at 127° C. for 30 seconds is based on the assumption of a development temperature of 127° C. For an anticipated higher or lower development temperature, the 20% reduction in optical density or absorbance should occur at that development temperature within a reasonable period of time. A reasonable development temperature range is between 180° F. (82° C.) and 380° F. (193° C.) and a reasonable dwell time is between 5 seconds and 5 minutes, preferably at between 220° F. (105° C.) and 350° F. (167° C.) for 10 to 180 seconds, with the longer times most likely associated with the lower development temperatures. Therefore, all of the absorbance characteristics are applicable to the generally useful development range of 82° C. to 193° C. Photothermographic imaging materials are well known in the art in various and sundry forms. Silver reduction systems (e.g., as disclosed in U.S. Pat. Nos. 3,457,075 and 3,849,049), thermal diazonium salt systems (e.g., as described in U.S. Pat. No. 3,754,916), and others are examples of these systems. Typical constructions of these photothermographic systems will comprise one or two layers which constitute a photothermographic imaging system coated over a base. If the support base is transparent, the heat-bleachable layer of the present invention may be coated either between the imaging layers and the base or on the backside of the base. If coated between the base and the imaging layer, it is desirable to minimize competing reactions. This can be done, for example, by selecting polymers and solvent systems for the various layers which will not promote migration between the layers. When the base is opaque, the heat-bleachable layer must be between the imaging layers and the base. This would, of course, also be true if there were more than one imaging layer.

All of this will be more thoroughly understood by consideration of the following examples:

EXAMPLES 1–13

A three component system of the present invention was evaluated by using nickel nitrate hexahydrate, phthalic acid and a merocyanine dye of the formula

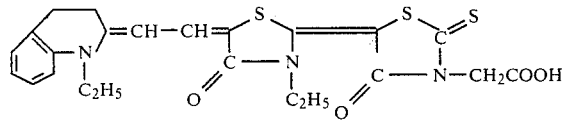

The dye was provided as a solution of 0.8 g dye/100 ml of a solvent comprising 50/50 volume proportions of methanol and N-methylpyrollidone. Three different concentrations of each ingredient were used. These ingredients were added to 2.5 g methanol and 12.5 g of a 10% by weight solids solution of polyvinylbutyral (as a binder) and methanol. The solutions were coated at 0.076 mm thickness on a polyester backing then dried for 3 minutes at 70° C. Maximum optical density ($D_{max}$) readings were taken. The coated sheets were then heated at 127° C. for 30 seconds and the final maximum optical density ($D_f$) measured. The difference between $D_{max}$ and $D_f$ is the change in optical density ($\Delta D$). The concentrations of materials and results appear in Table I.

TABLE I

| Example | Dye | Nitrate | Acid | Dmax | $D_f$ | Δ D |
|---|---|---|---|---|---|---|
| 1 | 2 ml | 0.025 g | 0.025 g | 0.34 | 0.09 | 0.25 |
| 2 | 6 ml | 0.025 g | 0.025 g | 0.74 | 0.21 | 0.53 |
| 3 | 2 ml | 0.025 g | 0.075 g | 0.31 | 0.08 | 0.23 |
| 4 | 6 ml | 0.025 g | 0.075 g | 0.89 | 0.22 | 0.67 |
| 5 | 2 ml | 0.075 g | 0.025 g | 0.41 | 0.09 | 0.32 |
| 6 | 6 ml | 0.075 g | 0.025 g | 0.87 | 0.14 | 0.73 |
| 7 | 2 ml | 0.075 g | 0.075 g | 0.32 | 0.09 | 0.23 |
| 8 | 6 ml | 0.075 g | 0.075 g | 0.80 | 0.14 | 0.66 |
| 9 | 4 ml | 0.050 g | 0.050 g | 0.53 | 0.12 | 0.41 |
| 10 | 6 ml | 0.15 g | 0.15 g | 0.76 | 0.09 | 0.67 |
| 11 | 6 ml | 0.30 g | 0.30 g | 0.77 | 0.11 | 0.66 |
| 12 | 2 ml | 0.15 g | 0.15 g | 0.13 | 0.07 | 0.06 |
| 13 | 2 ml | 0.30 g | 0.30 g | * | | |

*Bleached in drying oven at 70° C.

EXAMPLES 14–16

These examples evaluate the benefits of an acidic environment of the bleaching or decolorizing of the present invention. For this example, a dye of the structure

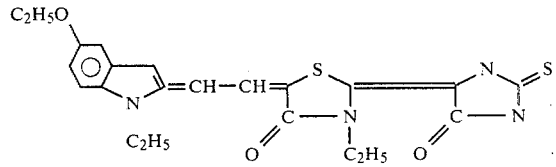

was used in a solution having 0.8 g dyes/100 ml of solvent comprising a 50/50 volume solution of methanol and N-methyl-pyrolidone. The coating solutions were as follows:

| Example | Dye | Acid | Nitrate |
|---|---|---|---|
| 14 | 3 ml | 0.025 g | 0.025 g |
| 15 | 3 ml | 0 | 0.025 g |

-continued

| Example | Dye | Acid | Nitrate |
|---|---|---|---|
| 16 | 3 ml | 0 | 0.30 g |

The acid was phthalic acid, the nitrate was nickel nitrate hexahydrate. The coating solution was prepared, coated, and dried as in Example 1, then heated for thirty seconds at 260° F. (127° C.). Example 14 bleached from medium blue to pale yellow, 15 became a lighter purple, and 16 became a light yellow. This shows that in the absence of an acid environment, greater concentrations of nitrate are desirable for more complete bleaching.

EXAMPLES 17-24

These examples show the wide variety of acids which can be used in the construction and indicates that the acid functionality is not dependent upon the structure of the acid. All constructions were identical to those of Examples 14-16 except that 5.5 ml of dye and 0.05 g of nickel nitrate hexahydrate were used. The sheets were heated at 127° C. for 30 seconds in an inert fluorocarbon bath. All sheets were initially a medium blue.

| Example | Acid | Amount | Final Color |
|---|---|---|---|
| 17 | phthalic | 0.025 g | Lt. Yellow |
| 18 | 1,2-cyclohexanedicarboxylic | 0.026 g | Lt. Yellow |
| 19 | 5-sulfosalicyclic | 0.038 g | Lt. Yellow |
| 20 | glutaric | 0.02 g | Lt. Yellow |
| 21 | lauric | 0.06 g | Lt.-Pink Purple |
| 22 | benzoic | 0.037 g | Lt.-Pink Purple |
| 23 | 2-naphthoic | 0.051 g | Lt. Yellow |
| 24 | 2,3-naphthalenedicarboxylic | 0.033 g | Lt. Yellow |

EXAMPLE 25

This example demonstrates the use of the heat-decolorizable layer as an antihalation backing for a photothermographic film.

A solution was prepared by dissolving 8 g of magnesium nitrate hexahydrate and 12 g of phthalic acid in 75 g of methanol. This was broken down into aliquots of 3 g of solution, to which were added 4 ml of dye solution containing 0.15 g of malachite green and 0.05 g of crystal violet in 10 ml of a 50/50 volume solution of methanol and N-methylpyrolidone.

Crystal violet has an oxidation potential greater than +1.0 and has the structure:

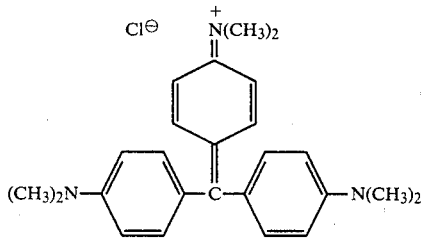

Acid malachite green, also used in the practice of the present invention, has the same structure except that one of the dimethylamine groups has been replaced by a hydrogen atom.

To the dye and nitrate containing solution was added 12.5 g of a solution of 15% by weight cellulose acetate, 10% methylisobutylketone, 10% methanol, and 65% acetone. The final solution was coated onto the backside of a commercially available photothermographic film (3M Dry Silver Film Type 8220) which comprises a transparent backing having an imageable layer thereon comprised of silver halide in catalytic proximity to silver behenate in a binder with a mild silver reducing agent. These materials are well described in U.S. Pat. No. 3,475,075. The coating thickness was 3 mils and was dried for 3 minutes at 70° C. A photothermographic film with the antihalation backing was exposed at the same time as the sample without the backing to artificial daylight through a continuous step wedge. Both examples were then developed at 127° C. for 30 seconds. The antihalation backing bleached to a pale yellow. The effect of the antihalation layer was obvious to the untrained eye. Image flare was significantly reduced.

EXAMPLE 26

The antihalation backing of the previous example was coated on transparent polyester film and dried at 70° C. The colored film was thermographically exposed imagewise in a thermographic copier ("Secretary" Copier by 3M). The film bleached in an area corresponding to the image on the original. This demonstrates the use of the films as an image producing element which, for example, could be used as a transparency for overhead projector.

There are a number of features of the present invention which should be noted. The imaging materials have excellent shelf life. They may set for months at ambient conditions and in room light without any deterioration in properties, to the degree that the dyes themselves are light stable. They are inexpensive to make and have a broad range of utility. No light sensitive materials need be present in the system and no external chemistry need be applied in order to develop an image. The absence of photosensitive and even thermally sensitive materials (except for whatever gives the present invention its thermally developable properties) is particularly noteworthy. No silver halides or diazonium salts are needed for light sensitivity and there is no need for the external application of toners. The present system is remarkable in its simplicity. The present system is light insensitive in that exposure to light does not sensitize or desensitize the construction to any form of thermal or chemical development. That is, if the imageable layer of the present invention is exposed to light in an imagewise fashion then generally heated or generally exposed to a reducing agent, there will be no image formed corresponding to the light exposure. This is true even when the layer is laminated to a light sensitive substrate.

EXAMPLES 27-39

Examples 1-13 were repeated for each of the following nitrate salts: Aluminum nitrate, nonahydrate, cobalt nitrate hexahydrate, zirconyl nitrate, ceric ammonium nitrate, barium nitrate, cupric nitrate trihydrate, silver nitrate, chromium nitrate nonahydrate, thorium nitrate tetrahydrate, bismuth nitrate pentahydrate, ferric nitrate nonahydrate, sodium nitrate and potassium nitrate. These systems also showed decolorizing effects. The multivalent salts tended to be significantly better than the monovalent salts, except that silver nitrate performed as well as many of the multivalent salts because of the oxidizing ability of the silver ion.

The imaging layers of the present invention may contain various materials in combination with the essential ingredients of the present invention. For example, lubricants, coating aids, antioxidants (e.g., ascorbic acid, hindered phenols, phenidone, etc. in amounts that would not prevent oxidation of the dyes when heated), surfactants, antistatic agents, mild oxidizing agents in addition to the nitrate, and brighteners may be used without adversely affecting practice of the invention.

The imaging layers of the present invention must allow reactive association of the active ingredients in order to enable imaging. That is, the individual ingredients may not be separated by impenetrable barriers within the layer, as with dispersed immiscible phases. Generally, the active ingredients are homogeneously mixed (e.g, a molecular mixture of ingredients) within the layer. They may be individually maintained in heat softenable binders which are dispersed or mixed within the layer and which soften upon heating to allow migration of ingredients, but this would require a longer development time.

As can be seen from the constructions of the examples, light sensitive or radiation sensitive components such as silver halide, photolabile halogen compounds, diazonium salts, or photooxidant compounds are not essential for the practice of the present invention. In fact, the preferred construction of the present invention is not light sensitive. That is, if the element were exposed to light in an imagewise manner prior to thermal development of the entire sheet, there would be no dramatic differential image formed. As almost all dyes fade or bleach with prolonged exposure to light, light insensitivity for the element must be defined as stated above, with the exposure being less than that capable of photobleaching the dye itself.

EXAMPLE 40

A coating composition comprising 2.0 grams phthalic acid, 0.3 grams crystal violet, 12.3 grams acetone, 15.4 grams N-methylpyrrolidone, 150 grams of 30% by weight solutions of polyvinylidine chloride in tetrahydrofuran (5%) and methylethylketone (65%) and 0.17 grams of quanidine and nitric acid in equal molar proportions was coated at 75 microns wet thickness on polyester base and dried for three minutes at 75° C. Imagewise heating for forty seconds at 290° F. (143° C.) provided an image with a $D_{min}$ of 0.17 and a $D_{max}$ of 0.86.

EXAMPLE 41

Each and every one of the dye structures listed above with Roman numerals was found to thermally imaging by bleaching in one of the following systems.

The first system tried was 3 ml of a dye solution formed by dissolving 0.1 g dye in 10 ml of a N-methylpyrolidone/methanol (50/50 volume). To this was added 0.05 g of $Ni(NO_3)_2.6H_2O$ and 0.05 g of phthalic acid in 2.5 g methanol. This was then combined with 12.5 g of a resin solution comprising 10% by weight cellulose acetate, 10% methylisobutyl ketone, and 80% acetone. If the dye did not bleach well when heated in this air dried composition, the proportions were varied by increasing the amount of $Ni(NO_3)_2.6H_2O$ and phthalic acid to 0.20 g each, increasing the cellulose acetate to 20% and the methylisobutyl ketone to 20% in the resin solution, while reducing the acetone to 60% in the resin solution. All of the dyes were shown thermally bleach in an imagewise fashion in this manner.

What is claimed is:

1. A light insensitive imageable layer comprising a synthetic polymeric binder, and within said binder (1) a dye, (2) a nitrate salt, and (3) an acid, said dye being present in said binder in sufficient concentration to provide an optical density of at least 0.1 in the visible region of the electromagnetic spectrum or to absorb at least 20% of incident radiation in a 50 nm range within the infrared or ultraviolet wavelengths of the electromagnetic spectrum, and said nitrate ion being present in a ratio of at least 0.1 moles/mole of dye, said nitrate salt in said binder being capable of liberating a sufficient quantity of an oxidizing agent selected from the class consisting of $HNO_3$, NO, $NO_2$, and $N_2O_4$ when heated to 200° C. for 60 seconds to oxidize said dye to a different color or colorless state.

2. The imageable layer of claim 1 wherein the concentration of dye is sufficient to provide an optical density of at least 0.3 in the visible region of the electromagnetic spectrum, the ratio of the moles of nitrate ion to moles of dye is at least 0.3, and said nitrate salt in said binder is capable of liberating said sufficient quantity of oxidizing agent when heated to 160° C. for 60 seconds to oxidize said dye to a different color or colorless state.

3. The imageable layer of claim 2 wherein the concentration of dye is sufficient to provide an optical density of at least 0.7 in the visible region of the electromagnetic spectrum and the ratio of the moles of nitrate ion to moles of dye is at least 0.5, said binder is a thermoplastic resin and where phenidone is present in said binder as an antioxidant.

4. The imageable layer of claim 1 wherein said acid is an organic carboxylic acid present as from 0.2 to 2.0 the molar amount of nitrate ion.

5. The imageable layer of claim 3 wherein the pH of said imageable layer is less than 7.0 and phenidone is present as an antioxidant.

6. The imageable layer of claims 4 or 5 wherein said nitrate ion comprises a metal nitrate salt.

7. The imageable layer of claims 4 or 5 wherein said nitrate ion comprises a hydrated metal nitrate salt.

8. The imageable layer of claims 4 or 5 which is light insensitive and wherein said dye has an oxidation potential less than +1.0, is selected from the group of dyes consisting of methines, indamines, anthraquinones, triarylmethanes, monoazos, oxazines, azines, thiazines, xanthenes, indigoids, cyanines, merocyanines, phenols, naphthols, and pyrazolones.

9. The imageable layer of claim 3 laminated to a photothermographic emulsion on the side of the emulsion away from the surface to be exposed to light.

10. The imageable layer of claims 4 or 5 wherein said nitrate salt is a hydrated salt of one of the group consisting of zinc, cadmium, nickel, aluminum, iron, copper, magnesium, chromium, cobalt, bismuth, lanthanum, gadolinium, and thorium.

11. The imageable layer of claims 4 or 5 where said layer is bonded between a support base layer and a photothermographic imaging layer.

12. THe imageable layer of claims 3, 4 or 5 which is light insensitive and wherein said dye is selected from the group of dyes consisting of methines, indamines, anthraquinones, triarylmethanes, monoazos, oxazines, azines, thiazines, xanthenes, indigoids, cyanines, merocyanines, phenols, napthols, and pyrazolones and said nitrate salt is a hydrated metal nitrate salt.

* * * * *